US008736465B2

(12) United States Patent
Rutherford et al.

(10) Patent No.: US 8,736,465 B2
(45) Date of Patent: May 27, 2014

(54) AIRCRAFT TRAFFIC DISPLAY

(75) Inventors: Steve M. Rutherford, Grand Rapids, MI (US); Dennis Polischuk, Rockford, MI (US)

(73) Assignee: L-3 Communications Avionics Systems, Inc., Grand Rapids, MI (US)

( * ) Notice: Subject to any disclaimer, the term of this patent is extended or adjusted under 35 U.S.C. 154(b) by 253 days.

(21) Appl. No.: 13/351,079

(22) Filed: Jan. 16, 2012

(65) Prior Publication Data

US 2012/0182161 A1 Jul. 19, 2012

Related U.S. Application Data

(60) Provisional application No. 61/433,342, filed on Jan. 17, 2011.

(51) Int. Cl.
*G08B 21/00* (2006.01)

(52) U.S. Cl.
USPC ..... 340/945; 340/961; 340/971

(58) Field of Classification Search
USPC ..... 340/945, 961, 963, 964, 971; 701/301
See application file for complete search history.

(56) References Cited

U.S. PATENT DOCUMENTS 5,596,332 A * 1/1997 Coles et al. ..... 342/455
5,933,099 A * 8/1999 Mahon ..... 340/961
6,173,159 B1 1/2001 Wright et al.
7,043,355 B2 * 5/2006 Lai ..... 701/120
7,420,501 B2 9/2008 Perl
2008/0211709 A1 9/2008 Smith et al.
2010/0207845 A1 8/2010 Pal et al.

OTHER PUBLICATIONS

International Search Report (Form PCT/ISA/210) and Written Opinion of the International Searching Authority (Form PCT/ISA/237) from corresponding Patent Cooperation Treaty Application No. PCT/US12/21469, mailed Mar. 27, 2012.
International Preliminary Report on Patentability from corresponding Patent Cooperation Treaty Patent Application No. PCT/US2012/021469 mailed Mar. 13, 2014.

* cited by examiner

*Primary Examiner* — Toan N Pham
(74) *Attorney, Agent, or Firm* — Gardner, Linn, Burkhart & Flory, LLP

(57) ABSTRACT

A system and method for displaying additional traffic information beyond that received from an ADS-B or other transponder communication. Such additional traffic information may be displayed on a display screen within a cockpit, and may include such things as an aircraft's make, model, manufacturer, or other information. The additional information may be displayed as text, or one or more pictures, icons, or symbols that correspond to this additional information, or any combination of text and such items. The additional information may be determined from one or more databases that correlate information received in the transponder communication to the additional information that is not contained within the transponder communication.

4 Claims, 5 Drawing Sheets

AIRCRAFT TRAFFIC DISPLAY

CROSS REFERENCE TO RELATED APPLICATIONS

This application claims priority from U.S. provisional patent application Ser. No. 61/433,342, filed on Jan. 17, 2011, the disclosure of which is hereby incorporated herein by reference in its entirety.

BACKGROUND OF THE INVENTION

The present invention relates to aircraft displays, and more particularly to aircraft displays that display traffic information, such as, but not limited to, traffic collision avoidance systems (TCAS).

Cockpit display devices for displaying aircraft traffic have been known for years. Such devices generally operate by monitoring transponder signals emitted from nearby aircraft. Based upon the information transmitted within the transponder signals, as well as the timing of the transponder signals, the cockpit display device is able to determine the location of the neighboring aircraft relative to the device's ownship. Such display devices are commonly referred to as traffic collision avoidance systems (TCAS). The display device may display the location of the nearby aircraft in a variety of different manners, such as a plan view that shows the location of the neighboring aircraft as they would appear to a person looking down from above both the ownship and the neighboring traffic, three-dimensional views that indicate the neighboring aircrafts' locations in three dimensions, as well as other views.

In the past, the display of the neighboring traffic has been accomplished through the use of generic symbols that are applied to all detected traffic. Such generic symbols may include solid or hollow diamonds, circles, half-circles, and/or other shapes wherein each shape provides specific information about the position or bearing of the neighboring aircraft relative to the ownship. Positioned next to these generic symbols may be a vertical trend arrow that points up if the neighboring aircraft is ascending, or that points down if the aircraft is descending. Still further, a number may be positioned next to the generic symbol that indicates the relative altitude of the neighboring aircraft with respect to the ownship. For example, the number "+06" would indicate the neighboring aircraft was six hundred feet above the ownship, while the number "−03" would indicate the aircraft was three hundred feet below the ownship.

SUMMARY OF THE INVENTION

The present invention provides systems and methods for displaying the positions of neighboring traffic while also providing additional information about the traffic beyond what has been shown in prior displays. In various embodiments, the additional information may include any one or more of the following, or still other information: the neighboring traffic's tail number, flight number, airframe manufacturer, airframe model, airframe make, airframe common name, and/or pictures that correspond to the specific neighboring aircraft or the types of the neighboring aircraft. The appropriate additional information to display may be determined by consulting a database that correlates information received from the neighboring aircraft's transponder with the information that is to be displayed, or with information that enables the displayed information to be determined. The additional information may either replace or supplement the generic symbols displayed in prior traffic display systems.

According to one embodiment, a method of displaying air traffic information on a display screen positioned within a cockpit of an aircraft is provided. The method includes receiving at the aircraft an aircraft identification signal from another aircraft; correlating the aircraft identification signal from the another aircraft to a piece of information using data contained within a database; and displaying the piece of information on the screen.

According to another embodiment, a system is provided for displaying air traffic information on a display screen positioned within a cockpit of an aircraft. The system includes a receiver, a memory, and a controller. The receiver receives an aircraft identification signal from another aircraft. The memory contains a database. The controller communicates with the memory and correlates the aircraft identification signal from the another aircraft to a piece of information using data contained within the database. The controller also communicates the piece of information to the display screen.

According to still another embodiment, a system for displaying air traffic information within a cockpit of an aircraft is provided. The system includes a receiver, a memory, a controller, and a display screen. The receiver receives an aircraft identification signal that is broadcast from another aircraft as part of an automatic dependent surveillance-broadcast (ADS-B). The aircraft identification signal includes a mode S code that is unique to the another aircraft. The memory contains a database that contains information correlating the mode S code to at least either aircraft tail numbers, aircraft models, or both. The controller communicates with the memory and uses the database to correlate the aircraft identification signal from the another aircraft to the tail number or model that corresponds to the another aircraft. The display screen displays thereon at least one of the aircraft tail number and the aircraft model corresponding to the another aircraft.

According to still other embodiments, the piece of information displayed on the screen may include the manufacturer of the other aircraft. The aircraft identification signal may include eight characters of aircraft information received from an automatic dependent surveillance-broadcast (ADS-B) transmitted from the other aircraft at 1090 MegaHertz. The database may include data correlating twenty-four bit International Civil Aviation Organization (ICAO) codes to tail numbers, or aircraft models, or aircraft makes, or aircraft manufacturers, or to other information. The database may alternatively or additionally include data correlating tail numbers to at least one of aircraft models and aircraft manufacturers.

In still other embodiments, the display screen may display a picture of a type of airplane that corresponds to the other airplane. The display screen may display the picture, or other piece of information, at a location on the display screen that is indicative of the other aircraft's current location relative to the ownship. The display of the piece of information may also, or alternatively, display a common name for the particular aircraft. The aircraft identification signal may originate as part of a universal access transceiver (UAT) signal transmitted at 978 MegaHertz from the other aircraft. If the system or method includes the display of a picture corresponding to the other aircraft, the picture may be oriented upward, downward, or level to indicate whether the other aircraft is ascending, descending, or in level flight. Still further, in some embodiments, the display of the picture of the aircraft may be altered so that the picture shows the other aircraft as it would be seen by the pilot based upon the other aircraft's relative bearing and elevation to the ownship. Still other variations are possible.

DESCRIPTION OF THE EMBODIMENTS

Figure 1:
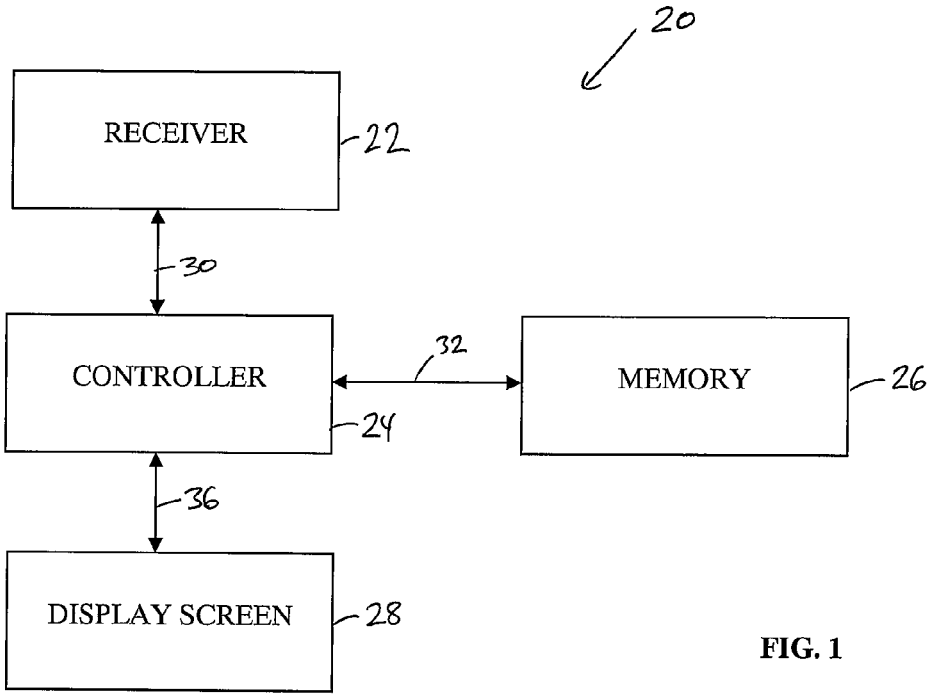
FIG. 1 is a block diagram of an air traffic display system according to one embodiment.

An air traffic display system 20 according to one embodiment is depicted in block diagram form in FIG. 1. Air traffic display system 20 is a system that may be installed within the cockpit of an aircraft in order to provide information about the locations of other aircraft. Such information provides the pilot with greater situational awareness and may aid the pilot in avoiding conflicts with the other air traffic.

Air traffic display system 20 functions to provide the pilot with additional pieces of traffic information that may not be contained within current transponder broadcasts. Such additional pieces of information may be displayed in a variety of different manners to the pilot. Such additional pieces of information may include things such as the tail numbers of aircraft, the flight numbers of aircraft, the aircraft manufacturer, the aircraft model, the aircraft make, one or more common names for an aircraft, and/or other information. Such information may be displayed on a display screen either in lieu of, or in addition to, one or more symbols that indicate the position of the air traffic. Such information thus gives the pilot more data about the air traffic beyond what conventional TCAS systems have done.

In the embodiment illustrated in FIG. 1, air traffic display system 20 includes a receiver 22, a controller 24, a memory 26, and a display screen 28. Receiver 22 is a device adapted to receive data that is broadcast from the transponders of the other aircraft that are within the vicinity of the aircraft in which system 20 is installed (the ownship). In some embodiments, receiver 22 may be a transponder itself. In other embodiments receiver 22 may be a device, or component of a device, that is separate from the aircraft's transponder. In such cases, receiver 22 receives selected information from the aircraft's transponder, as will be discussed below, and uses that information to supplement the air traffic information that is displayed to the pilot.

Controller 24 may comprise one or more microprocessors, systems-on-a-chip (SoC), field-programmable gate array, discrete logic circuits, or any other electronic structure or combinations of electronic structures capable of carrying out the algorithms discussed herein, as would be known to one of ordinary skill in the art. Such algorithms may be carried out in software, firmware, or dedicated hardware, or any combination of these. As will be discussed in greater detail below, controller 24 may include multiple components that are located at different physical locations within the cockpit, including one or more components positioned physically inside a first device, one or more additional components positioned inside a second device, and possibly additional components positioned inside other devices. As but one example, controller 24 may include a processor positioned inside of a transponder that decodes the other aircraft's transponder transmissions and transmits the decoded information to a second processor located elsewhere. The second processor may use the decoded information to look up additional pieces of information within a database, and then forward the additional pieces of information to a third processor located elsewhere. The third processor may then control the display of the additional pieces of information. Multiple other arrangements are possible.

Controller 24 communicates with receiver 22 over a communication link 30. Communication link 30 may take on a variety of different forms, depending upon the location and construction of receiver 22 and controller 24. In one embodiment, communication link 30 may be a standard electrical bus, such as an Aeronautical Radio, Incorporated (ARINC) 429 bus, or any other type of bus suitable for use in an aircraft. In still other embodiments, communications link 30 may be a purely internal communications link in which information is shared within a common physical unit between receiver 22 and controller 24. Other variations are also possible.

Air traffic display system 20 of FIG. 1 further includes a memory 26 that is in communication with controller 24. Memory 26 contains a database of information that correlates information received via receiver 22 to additional pieces of information that may be displayed upon display screen 28 in a manner discussed in greater detail below. Memory 26 may take on multiple different forms. In one embodiment, memory 26 may be a portable flash memory device—such as, but not limited to, a secure digital (SD) card, a compact flash (CF) card, a secure data high capacity (SDHC) card, or the like—that may be inserted into a corresponding port in communication with controller 24, or otherwise connected to controller 24. In other embodiments, memory 26 may be a hard drive, a CD-ROM, a random-access memory (RAM), read only memory (ROM), or any other type of memory capable of storing the additional pieces of data discussed below.

Memory 26 communicates with controller 24 over a memory link 32. Memory link 32 may be any suitable electronic link capable of communicating data between controller 24 and memory 26. In some embodiments, link 32 may be a purely internal link, such as, but not limited to, a conventional Serial Advanced Technology Attachments (SATA). In other embodiments, link 32 may involve communications between separate physical devices over an inter-device network, such as, but not limited to, an ARINC 429 bus. Still other types of structures may be used to link controller 24 to memory 26.

Display screen 28 is adapted to display images of air traffic data to a pilot. The physical construction of display screen 28 may vary, but in one embodiment it is a Liquid Crystal Display (LCD). In other embodiments, display screen 28 may include a cathode ray tube (CRT) or a plasma screen display, or any other type of display capable of displaying graphic images to a pilot. The images displayed by display screen 28 are based upon information generated from controller 24. Such information may be transmitted from controller 24 to display screen 28 over a display link 36 that enables controller 24 to transmit information to display screen 28. Display link 36 may be an internal or external electrical bus, or any other electrical component that enables controller 24 to communicate information to display screen 28 for display thereon.

In some embodiments, display screen 28 may be associated with one or more graphics processors that control the images displayed on display screen 28. Such a graphic processor, if present, may be considered part of controller 24, or it may be considered separate from controller 24. If considered separate, then controller 24 communicates with the graphics processor over display link 36. If considered part of controller 24, then controller 24 communicates directly with display screen 28 via display link 36.

Figure 4:
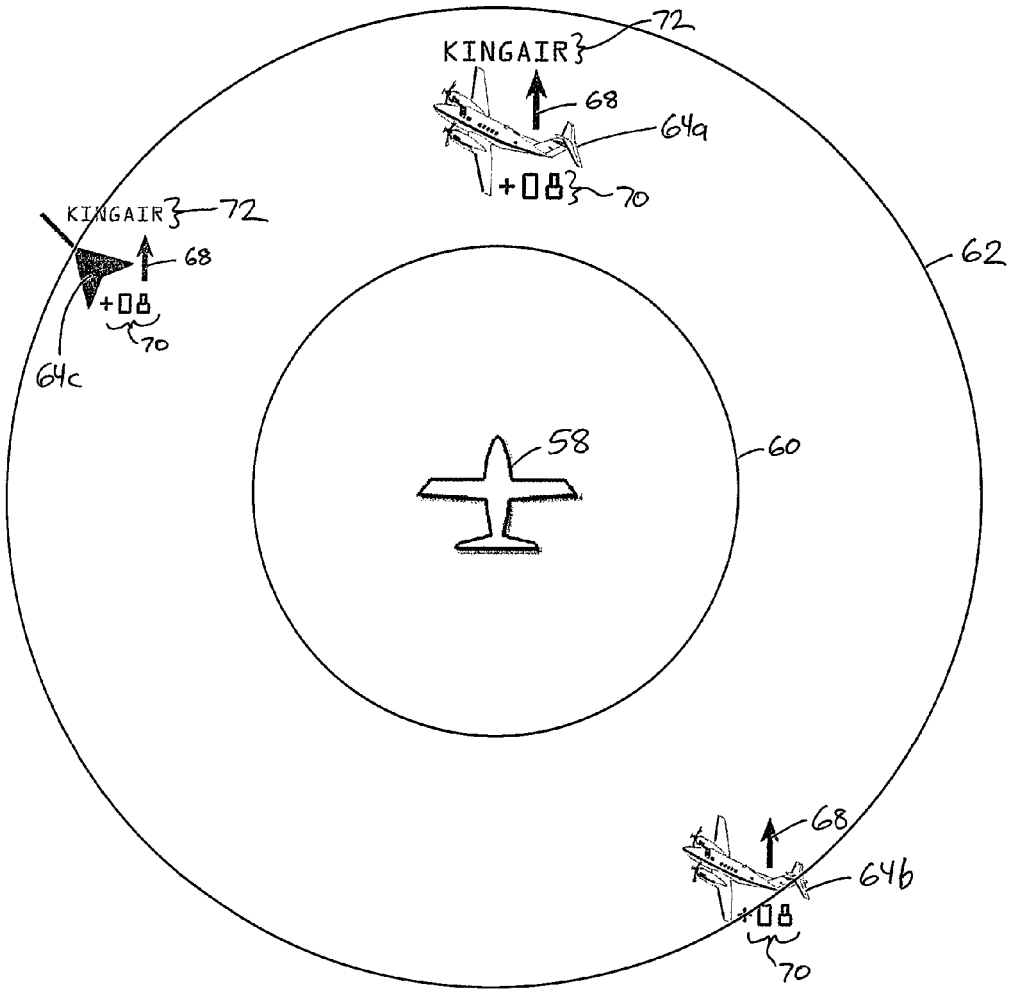
FIG. 4 is an illustrative example of several manners in which traffic data may be displayed according to any of the various embodiments.
Figure 5:
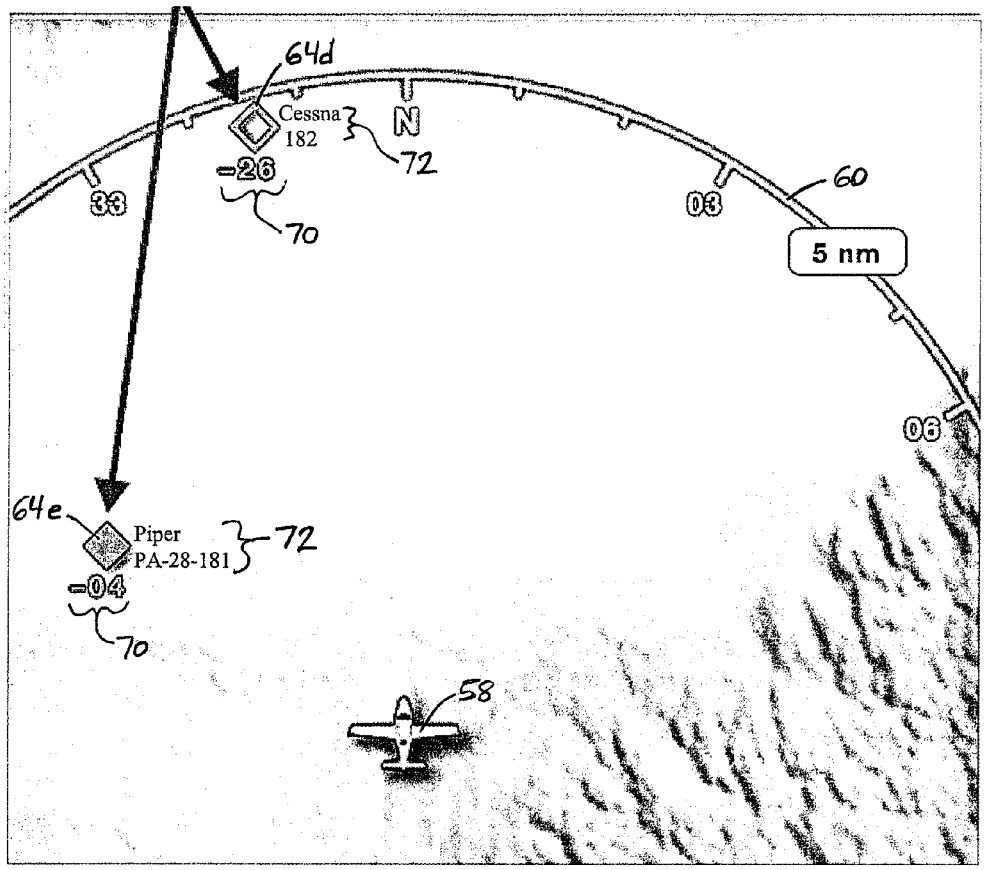
FIG. 5 is an illustrative example of another manner in which traffic data may be displayed according to any of the various embodiments.
Figure 6:
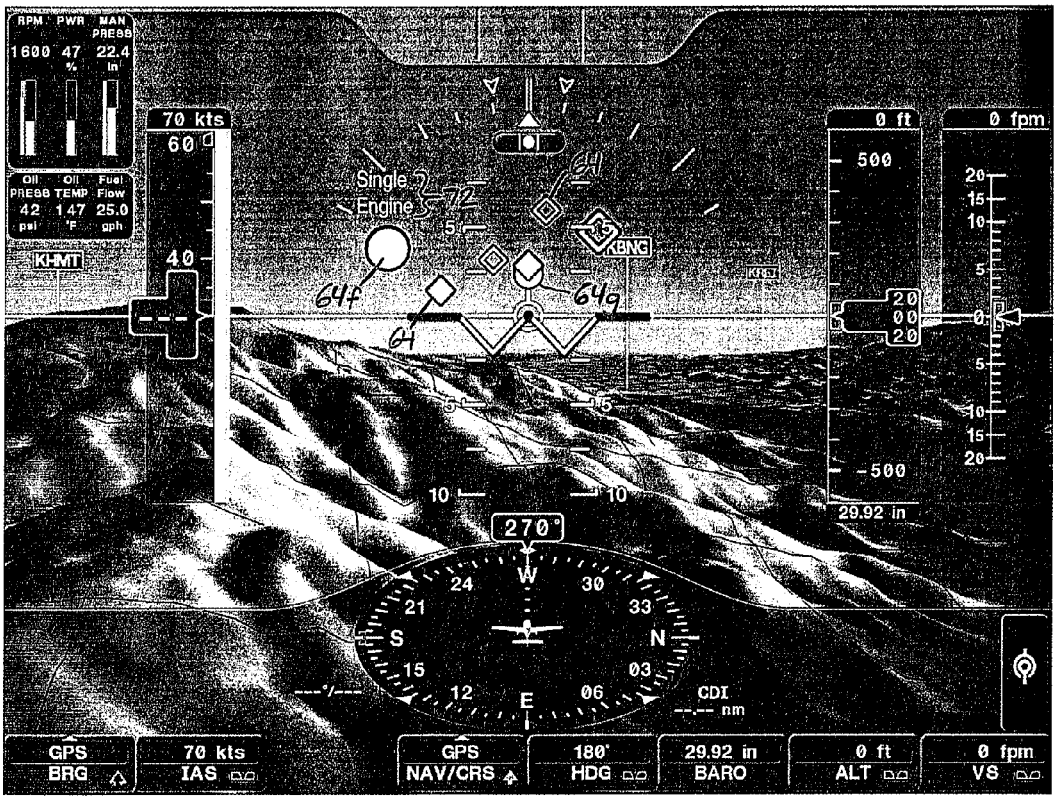
FIG. 6 is yet another illustrative example of another manner in which traffic data may be displayed according to any of the various embodiments.

Display screen 28 may display the images of air traffic data in a wide variety of different manners. In some embodiments, the air traffic may be displayed in a plan view orientation wherein the images on display screen 28 are shown from the perspective of an imaginary viewer positioned above all of the air traffic and looking down at the air traffic. One example of this type of image is shown in FIG. 4. In other embodiments, the plan view may be modified to include images of the terrain underneath the current location of the aircraft. One example of this type of view is shown in FIG. 5. In still other embodiments, the air traffic may be displayed as part of a synthetic vision image that mimics the three dimensional view that a pilot sees when looking out the cockpit of the aircraft. One example of this type of view is shown in FIG. 6. Still other images may be shown on display screen 28 corresponding to other viewpoints, such as exocentric three dimensional views, or still other types of views.

In the embodiment depicted in FIG. 1, display screen 28 may be a screen that is incorporated into a physical device that is specifically dedicated to displaying air traffic. That is, display screen 28 may be part of a stand-alone unit that only displays air traffic data to the pilot. As an alternative to such a stand-alone unit, display screen 28 may be incorporated into a device that displays other information besides just air traffic. One possible example of such an alternative embodiment is depicted in FIG. 2.

Figure 2:
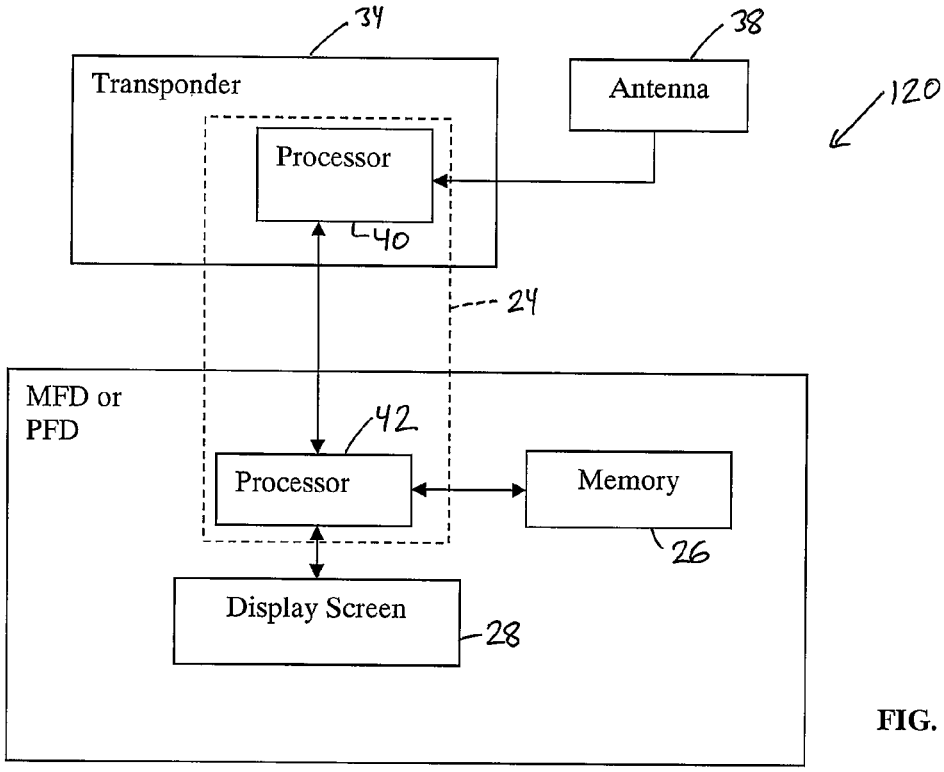
FIG. 2 is a block diagram of an air traffic display system according to another embodiment.

FIG. 2 shows an alternative air traffic display system 120 in which display screen 28 is incorporated into either a multi-function display (MFD) or a primary flight display (PFD). In this embodiment, the PFD or MFD will include pilot controls that can be manipulated to bring up an image showing the location of air traffic. System 120 will display these images with additional pieces of information, as will be discussed in greater detail below. Such additional pieces of information are obtained by consulting a database stored in memory 26. While the embodiment of FIG. 2 shows memory 26 positioned inside of the PFD or MFD, it will be understood that the physical location of memory 26 could be changed. Indeed, in one embodiment (not shown), both controller 24 and memory 26 could be positioned outside of the MFD or PFD, such as in a transponder 34 positioned on board the aircraft. In other embodiments, memory 26 could be positioned still elsewhere.

In the embodiment shown in FIG. 2, controller 24 is segmented into multiple processors that are split amongst multiple physical devices. More specifically, controller 24 includes a processor 40 located in transponder 34 and another processor 42 located in the PFD or MFD. Other types of segmentation of processors are also possible. In the embodiment shown in FIG. 2, processor 40 carries out some of the control functions of controller 24, while processor 42 carries out the remaining control functions of controller 24. Additional processors, coprocessor, or graphics processors may or may not be part of controller 24. In still other embodiments, controller 24 may also be positioned wholly within a single physical device, such as transponder 34 or the MFD or the PFD. When controller 24 is segmented into multiple processors, the functions carried out by each processor can be assigned in any suitable manner.

In the embodiment shown in FIG. 2, the receiver 22 is defined by transponder 34 and its associated antenna. Antenna 38 detects transponder signals transmitted from other aircraft and communicates them to transponder 34. Antenna 38 may be a conventional transponder antenna that is positioned at least partially outside of the aircraft in order to better pick up the broadcasted transponder signals. Such signals are forwarded by antenna 38 to transponder 34 for processing. As will be discussed more below, the transponder signals detected by antenna 38 and forwarded to transponder 34 include automatic dependent surveillance-broadcast (ADS-B) transponder signals. In addition to information identifying the location and heading of other aircraft, such ADS-B signals include, among other pieces of data, an International Civil Aviation Organization (ICAO) code that is twenty-four bits long and that uniquely identifies the broadcasting aircraft. Such ADS-B signals further include an eight character data field that identifies an aircraft's tail number or flight number. Controller 24 uses one or both of these pieces of information to determine additional information for display on display screen 28, as discussed more below.

Figure 3:
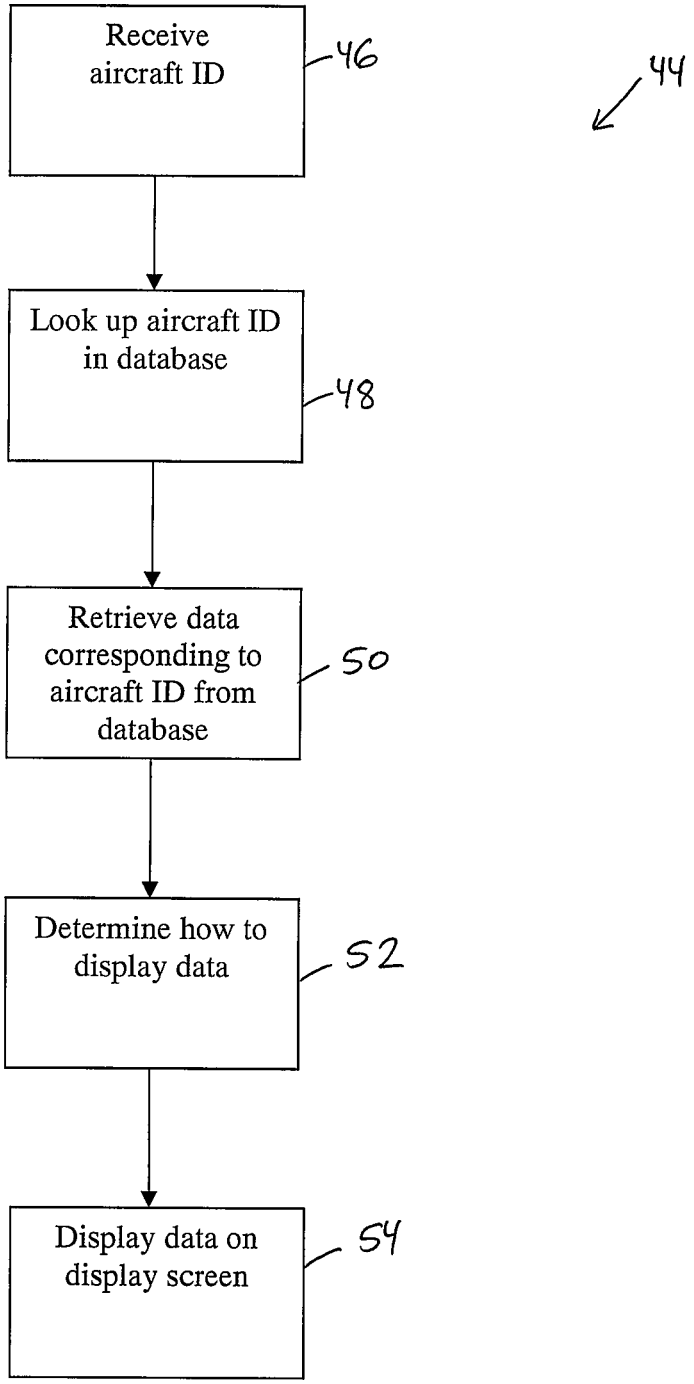
FIG. 3 is a flow chart of a method of displaying air traffic according to an embodiment.

FIG. 3 illustrates one example of an air traffic display method 44 according to one embodiment. At a first step 46, controller 24 receives an aircraft ID from receiver 22. As noted above, receiver 22 may include transponder 34 with its antenna 38, or it may take on other configurations. However configured, receiver 22 forwards an aircraft ID onto controller 24. The aircraft ID comes from an ADS-B transmission from another aircraft. The aircraft ID may refer to either or both of: (1) a twenty-four bit ICAO number, which is also referred to as a Mode S code, or (2) a tail number or flight number. Thus, controller 24 will receive information about the identity of a specific aircraft within the surrounding airspace and such information may be the aircraft's unique ICAO number, its tail number, its flight number, or any combination of these.

At step 48, controller 24 looks up the aircraft ID received in step 46 in one or more databases contained within memory 26. Such databases correlate the aircraft ID to additional pieces of information that may be usefully displayed on display screen 28. As one example, the database stored in memory 26 may contain data identifying the specific manufacturer of an aircraft for each ICAO number. That is, the database may correlate ICAO numbers to aircraft manufacturers. For example, if receiver 22 detects a transponder transmission that includes the ICAO number 52436447 (expressed in octal, but which corresponds to 1010 1010 0011 1101 0010 0111 when expressed in binary), controller 24 would consult a database in memory 26 that correlates this specific ICAO number to an aircraft manufactured by Cessna. The data contained within this database is available from the United States Federal Aviation Administration's (FAA) registry of aircraft, as well as potentially other sources.

The data contained within memory 26 may include any or all of the data contained with any governmental body's aircraft registry, such as, for example, the United States' FAA. For a given aircraft, the FAA aircraft registry includes the aircraft's serial number, manufacturer name, model, type of aircraft, year of manufacture, registration type, tail number, engine type, engine manufacturer, and other information. Any one or more pieces of this information may be looked up by controller 24 in step 48.

At step 50, controller 24 retrieves any one or more of these pieces of information from memory 26. For example, in one embodiment, controller 24 may be configured to look up an aircraft's manufacturer and model in memory 26. As noted, this is performed by using the aircraft ID retrieved by controller 24. In such an embodiment, memory 26 would contain data correlating this aircraft ID to at least the corresponding aircraft make and manufacturer. Thus, for example, if controller 24 in such an embodiment received the aircraft ID of 52436447 from receiver 22, it would use this ID to retrieve from memory 26 information identifying this aircraft as being manufactured by Cessna and being a model 182Q. If another aircraft ID were received by receiver 22, controller 24 would use that to look up the corresponding aircraft manufacturer and make of that aircraft.

In some embodiments, the retrieval of data at step 50 may involve consulting multiple databases. Such multiple databases may contain further information that may be used by air traffic display system 20.

At step 52, controller 24 determines how to display the additional piece or pieces of information retrieved from memory 26. There are multiple different manners in which such information may be displayed. In some embodiments, the information may be displayed as text positioned next to a symbol corresponding to a particular aircraft. In other embodiments, the information may be displayed as a picture positioned at a location corresponding to the current position of the aircraft. In still other embodiments, the information may be displayed as a combination of both text and pictures.

Controller 24 may consult another database, or follow other steps when determining how to display the additional information. For example, in one embodiment, controller 24 may be programmed, or otherwise configured, to cause a picture corresponding to a specific aircraft type to be displayed on display screen 28. In such an embodiment, controller 24 may consult an additional database that correlates specific pictures to specific types of aircraft. As but one example, if controller 24 retrieves an aircraft make and manufacturer at step 50 that correspond to a Piper PA-24 Commanche, controller 24 may consult a database or other files that store a picture corresponding to this aircraft model. The picture may be a picture of this specific model, or it may be a picture of an aircraft corresponding to a class of aircraft of which the Piper PA-24 Commache is a member. As one example, the classes could include those defined by the FAA in the aircraft registry. However, other classes could also be used. The picture could be one of photographic quality of the aircraft, or aircraft type, or it could be a picture that is less photographic and more symbolic.

If traffic display system 20, or 120, is configured to display aircraft pictures, then step 52 may involve the additional determination of the size and/or orientation at which the picture will be displayed on display screen 28. This determination may involve taking into account the aircraft's current distance from the ownship, as well as its heading relative to the ownship. In such cases, the picture may be reduced in size based upon greater distances from the ownship, and vice versa. Similarly, the orientation of the picture may be adjusted to match the orientation of the aircraft relative to the ownship. Such orientation adjustments may involve changing the orientation of the picture based upon whether the aircraft is ascending or descending, as well as the current heading of the aircraft. In some embodiments, the picture may be a generated entity that is created in a way that matches the perspective of the pilot in the ownship.

The display of information is carried out by controller 24 at step 54. As was noted, the manner in which the data retrieved from memory 26 is displayed can be varied widely in different embodiments. FIG. 4 provides an illustration of several different manners in which such information may be displayed. More specifically, FIG. 4 shows several different manners in which information may be displayed on display screen 28.

FIG. 4 displays an ownship symbol 58 positioned generally near the center of display screen 28. The ownship symbol 58 represents the position of the aircraft on which air traffic display system 20 is positioned. A pair of concentric circles 60 and 62 may be positioned around the ownship symbol 58 to illustrate distances from the ownship. That is, first concentric circle 60 may, for example, identify a distance of five nautical miles from the ownship, while second concentric circle 62 may identify a distance of ten nautical miles from the ownship. Other distances can, of course, be displayed.

FIG. 4 further includes the display of other aircraft that are within the vicinity of the ownship 58. In the example of FIG. 4, there are three such aircraft 64. They are labeled as aircraft 64*a*, 64*b*, and 64*c* in FIG. 4. In the example of FIG. 4, each aircraft 64*a*, 64*b*, and 64*c* is displayed in a different manner. This has been done for purposes of illustrating the variety of different embodiments that are contemplated herein. In an actual system, display screen 28 would typically only use one format for displaying air traffic which would be applied to all aircraft, rather than mixing display formats as has been done in FIG. 4.

System 20 in FIG. 4 shows aircraft 64*a* displayed as a picture. The picture corresponds to the type of aircraft that aircraft 64*a* actually is—in this case, a Kingair. In addition to displaying a picture of the aircraft, display screen 28 also includes a trend indicator arrow 68 and an elevation indicator 70. Trend arrow 68 in FIG. 4 is pointing upward, which indicates that aircraft 64*a* is ascending. Were aircraft 64*a* descending, trend indicator arrow 68 would be pointing downward. If aircraft 64*a* were flying level, trend indicator arrow 68 could be removed. Elevation indicator 70 includes a number that identifies in specified units, such as hundreds of feet, the elevation of aircraft 64*a* relative to the ownship. Thus, in the example of FIG. 4, aircraft 64*a* is 800 feet above the ownship 58.

The display of the picture corresponding to aircraft 64*a* in FIG. 4 may carried out in accordance with air traffic display method 44. That is, aircraft 64*a* may broadcast a transponder message that is received by receiver 22 aboard the ownship. The transponder message may be an ADS-B transmission, which will not include a data field indicating the aircraft is a Kingair. However, the ADS-B transmission will include the both the ICAO code for aircraft 64*a*, as well as the tail number of aircraft 64*a*. Using either or both of these pieces of information, controller 24 will look up the type of aircraft corresponding to the ICAO code or the tail number in memory 26 at step 48. At step 50, controller 24 will retrieve information that identifies aircraft 64*a* as a Kingair aircraft. At step 52, controller 24 will select a picture that should be displayed on display screen 28 that corresponds to a Kingair aircraft. In making this selection, controller 24 may also choose to orient the picture in a manner that corresponds to the current ascent or descent of the aircraft. In this case, because aircraft 64*a* is ascending, the picture is displayed with the nose of the aircraft pointing upward.

Aircraft 64*a* is also shown in FIG. 4 with a text field 72 positioned adjacent the picture of the Kingair. Text field 72 may be used to display additional text regarding aircraft 64. In the example of FIG. 4, text field 72 contains the word "Kingair," which tells the pilot that aircraft 64*a* is a Kingair aircraft. The type of information displayed in text field 72 may be changed to correspond to any one or more of the different types of data contained with the FAA, or other governmental, aircraft registry. Thus, text field 72 could be populated with any one or more of the following: the aircraft's serial number, manufacturer name, model, type of aircraft, year of manufacture, registration type, tail number, engine type, engine manufacturer, or the like. Still further, any of the data contained within the registry could be modified, supplemented, or replaced with other data. For example, the display of the word "Kingair" may be considered the display of either a common name for an aircraft, or an abbreviated descriptor of the model since there are multiple different models of Kingair aircraft. When displaying such modified, supplemented, or abbreviated information, controller 24 may initially retrieve information from memory 26, such as the aircraft's model, and then use that model information to generate the supplement, abbreviated, or modified information, such as by consulting another database, or by following established algorithms, or a combination of the two, or in still other manners.

The use of text field 72 is optional and but one manner in which controller 24 may be configured to display information on display screen 28. FIG. 4 illustrates another manner of displaying an aircraft that does not use a text field 72. Specifically, aircraft 64*b* is displayed in the same manner as aircraft 64*a* except for the removal of text field 72. The display of the picture of aircraft 64*b* may be carried out in the same manner as described above with respect to aircraft 64*a*. The orientation of the picture of aircraft 64*b* may be adjusted to match the orientation of aircraft 64*b* relative to the ownship.

FIG. 4 illustrates yet another manner in which an aircraft may be displayed on display screen 28. Specifically, aircraft 64*c* is shown on FIG. 4 at a location approximately 10 nautical miles away from ownship 58. Aircraft 64*c* is displayed with a text field 72 that identifies the aircraft as a Kingair. The display of aircraft 64*c*, however, unlike aircraft 64*a* and 64*b*, utilizes a symbol for the aircraft rather than a picture of an aircraft. As with the pictures of the aircraft, the symbol used for displaying aircraft 64*c* may be oriented in a manner to correspond to aircraft 64*c*'s orientation relative to ownship 58. For both aircraft 64*b* and 64*c*, both a vertical trend indicator 68 and an elevation indicator 70 may be positioned next to the aircraft.

While text field 72 positioned next to aircraft 64*c* includes the same textual information as text field 72 positioned next to aircraft 64*a*, it will be understood by those skilled in the art that the content of text field 72 for aircraft 64*c* can be modified to include any of the information discussed above. That is, regardless of whether an aircraft is displayed as a symbol, a picture, or other type of image, the content of text field 72 can be chosen as desired.

The position at which each aircraft 64*a*, 64*b*, and 64*c* is shown on display screen 28 relative to ownship 58 is determined from the transponder signals, and this may be accomplished in any conventional or known manner used in TCAS systems.

FIG. 5 illustrates yet another manner in which air traffic display system 20 may display traffic information. FIG. 5 differs from FIG. 4 in that the contours of the terrain underlying the aircraft is displayed on display 28 in addition to the location of the aircraft. The display of these contours may be carried out in any known manner. FIG. 5 also differs from FIG. 4 in that a different format has been chosen for displaying the individual aircraft 64. FIG. 5 shows two aircraft: 64*d* and 64*e*. Each of these aircraft is displayed as a symbol which may change depending upon the location of the aircraft relative to ownship 58. For example, aircraft 64*d* is displayed as a hollow diamond. The hollow diamond symbol may represent the fact that aircraft 64*d* is within detection range of ownship 58, but not in a position and/or orientation that causes a traffic advisory or proximity advisory condition. Depending upon the relative movement of aircraft 64*d* and ownship 58, the status of aircraft 64*d* may change to one constituting a traffic advisory or a proximity advisory. In either case, display screen 28 may change the hollow diamond symbol to another symbol. The change may involve merely a color change, or a change in shape, or a change in both color and shape.

One example of such a changed symbol is shown with respect to aircraft 64*e* in FIG. 5. Aircraft 64*e* is shown in FIG. 5 as a solid diamond and constitutes a proximity advisory condition due to is position vis-à-vis ownship 58. To indicate this different condition to the pilot, a solid diamond symbol is used to identify aircraft 64*e* instead of the hollow diamond symbol used for aircraft 64*d*. Other types of symbol changes or color changes may be used.

For both aircraft 64*d* and 64*e*, controller 24 has been configured in the illustrative example of FIG. 5 to populate text field 72 with both the aircraft manufacturer and the aircraft model. Thus, the text field 72 for aircraft 64*d* includes the text "Cessna 182," which identifies aircraft 64*d* as being manufactured by Cessna and being a model 182. Similarly, the text field 72 for aircraft 64*e* includes the text "Piper PA-28-121," which identifies aircraft 64*e* as being manufactured by Piper and being a model PA-28-121. The content of text fields 72 is determined in accordance with air traffic display method 44. That is, the make and manufacturer of each airplane are determined by consulting a database stored in memory 26 that correlates either the tail number, the flight number, or the ICAO code to the aircraft make and manufacturer. Such databases are publicly available. As noted above, the tail number or flight number are sent as part of the ADS-B transponder transmission, as well as the ICAO code.

FIG. 6 illustrates yet another manner in which controller 24 may be configured to display traffic information on display screen 28. FIG. 6 illustrates a synthetic vision image that may be displayed on a PFD or MFD within the cockpit of the aircraft. Such synthetic vision systems create visual images that mimic what the pilot would see looking out the front of the aircraft in clear conditions. Various manners for creating such synthetic images are known.

In the image of FIG. 6, several aircraft 64 are displayed, including aircraft 64*f*. As with the other images shown in FIGS. 4 and 5, the aircraft 64 are displayed on display screen 28 at locations that match the aircraft's actual locations, as determined from their transponder communications. In the example of FIG. 6, controller 24 has been configured to selectively display a text field 72 next to one or more aircraft based upon the aircraft's relative position to the ownship. In other words, in order to avoid potentially excessive cluttering of the display, controller 24 only displays text field 72 next to certain aircraft 64. The specific criteria used in determining whether to display text field 72 can be varied in any desirable manner.

In the example of FIG. 6, controller 24 has only displayed a text field next to aircraft 64*f* because aircraft 64*f* has a position vis-à-vis the ownship that has generated a traffic advisory. The conditions constituting a traffic advisory may vary with the manufacturer of the MFD or PFD, or be based on other factors. Aircraft 64*g*, which is also generating a traffic advisory in the example of FIG. 6, does not have a text field 72 positioned adjacent thereto because of the close proximity of other aircraft 64 thereto. This close proximity could create confusion as to whether or not a text field 72 positioned next to aircraft 64*g* applied to aircraft 64*g*, or one of the other nearby aircraft. Consequently, controller 24 has not displayed text field 72 for aircraft 64*g*.

In the example of FIG. 6, controller 24 has been configured to display in text field 72 information identifying the type of the aircraft, rather than its make or manufacturer. This has been done for illustrative purposes. As was noted above, controller 24 may be configured to include whatever information is desirable within text field 72. Further, controller 24 may be configured to use symbols or pictures or other icons to represent the location of aircraft 64, and controller 24 may be configured to alter when and how any of this information is displayed based upon any desirable criteria. In short, controller 24 may display any of the data retrieved in step 50 on display screen 28 in any desirable manner, and that manner may change during flight based upon any desirable conditions or it may remain static.

When system 20 includes a display screen 28 on which a three dimensional image is displayed—such as, but not limited to, images of the type shown in FIG. 6—controller 24 may be programmed or otherwise configured to display pictures of aircraft that change based upon the orientation of the aircraft relative to the ownship. For example, if an aircraft were flying toward the ownship, the picture on display screen 28 corresponding to that aircraft would be oriented with its nose pointed toward the pilot. If the aircraft were flying away from the ownship, the picture would be oriented with its tail pointed toward the pilot. If it were flying rightward or leftward relative to the ownship, the picture would display either a right or left side view of the aircraft. Additional changes to the picture could be included to generate a picture that took into account the variations in height relative to the ownship, as well as the distance between the aircraft (i.e. smaller pictures for more distant aircraft). Ascent and descent could be indicated by pointing the nose of the aircraft picture up or down. In general, if pictures of aircraft are displayed on screen 28, such pictures could, in at least one embodiment, be repetitively generated to provide images that mimicked how the pilot would see the aircraft from his or her vantage point.

In any of the various embodiments discussed above, controller 24 may be configured to retrieve data from the database at step 50 only once for each individual aircraft. That is, controller 24 need not be configured to consult the database for each and every transponder transmission received. Instead, as one possibility, controller 24 could store the retrieved data in a more accessible memory location so that the database didn't need to be consulted for each subsequent transponder transmission. However, in some embodiments, controller 24 could be configured to consult the database more than once for a given aircraft.

Whatever data is stored in memory 26 may desirably be updated periodically. Such updates can occur in any known manner. As one possibility, if memory 26 includes a portable flash memory device, the portable device could be removed periodically and connected to another computer having access to the latest information. As another possibility, controller 24 might be configured to be able to wirelessly communicate with a laptop or other computer having the most recent database information. Other manners of updating are also possible.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The embodiments of the invention in which an exclusive property or privilege is claimed are defined as follows:

1. A system for displaying air traffic information within a cockpit of an aircraft, said system including:

a receiver adapted to receive an aircraft identification signal broadcast from another aircraft as part of an automatic dependent surveillance-broadcast (ADS-B), said aircraft identification signal including a mode S code that is unique to said another aircraft;

a memory containing a database, said database including information correlating mode S codes to at least one of aircraft tail numbers and aircraft models;

a controller in communication with said memory and adapted to use said database to correlate said aircraft identification signal from the another aircraft to at least one of an aircraft tail number and an aircraft model corresponding to said another aircraft; and a display screen in communication with said controller and adapted to display thereon at least one of said aircraft tail number and said aircraft model corresponding to said another aircraft.

2. The system of claim 1 wherein said display screen further displays a picture corresponding to said another aircraft.

3. The system of claim 2 wherein said picture is oriented in a manner corresponding to the another aircraft's current ascent, descent, or level flight.

4. The system of claim 2 wherein said picture is adjusted in a manner corresponding to the another aircraft's current heading relative to the aircraft.

* * * * *